US007053540B2

(12) United States Patent
Bobel

(10) Patent No.: US 7,053,540 B2
(45) Date of Patent: May 30, 2006

(54) ENERGY EFFICIENT COMPACT FLUORESCENT REFLECTOR LAMP

(76) Inventor: Andrzej Bobel, 640 Leland Ct., Lake Forest, IL (US) 60045

( * ) Notice: Subject to any disclaimer, the term of this patent is extended or adjusted under 35 U.S.C. 154(b) by 321 days.

(21) Appl. No.: 10/726,143

(22) Filed: Dec. 2, 2003

(65) Prior Publication Data

US 2005/0116604 A1 Jun. 2, 2005

(51) Int. Cl.
*H01J 5/48* (2006.01)
*H01J 5/50* (2006.01)

(52) U.S. Cl. ..... 313/318.1; 313/318.01; 313/318.11; 313/318.09; 313/493; 313/573; 362/310; 362/296; 362/341; 439/611

(58) Field of Classification Search ..... 313/318.1, 313/318.01, 318.11, 318.09, 318.04, 113; 362/296, 310, 341, 365, 366, 368, 377, 378, 362/430, 220, 436–438; 439/533, 569, 605, 439/220, 619, 611, 613–616
See application file for complete search history.

(56) References Cited

U.S. PATENT DOCUMENTS 5,465,025 A * 11/1995 Hendrickson ..... 313/318.09
5,568,009 A * 10/1996 Gandhi ..... 313/318.01
5,720,548 A * 2/1998 Geary ..... 362/260

* cited by examiner

*Primary Examiner*—Ashok Patel

(57) ABSTRACT

An energy efficient fluorescent reflector lamp includes a fluorescent light source enclosed in a reflector with a defined cavity and circumferential rim defining a light emitting opening, and a circumferential flange at a mating opening. The reflector cavity enclosed with a lens at the rim, has an interior wall as a reflective surface for directing light out from light emitting opening. The fluorescent light source is attached to a base located inside the reflector cavity and located inside the mating opening. The circumferential flange diameter is larger than a diameter of the mating opening. The base is assembled and locked together with a ballast housing of defined space sufficient to accommodate an electronic ballast and an electricity supply base. The ballast energizes the fluorescent light source to emit light, and the ballast includes power input terminals connected to said electricity supply base and output terminals connected to said fluorescent light source. The fluorescent reflector lamp has luminous efficacy which exceeds that of corresponding halogen reflector lamps while having an overall outline fitting substantially within the ANSI specified outline for PAR lamps.

18 Claims, 16 Drawing Sheets

Fig.11 (a)
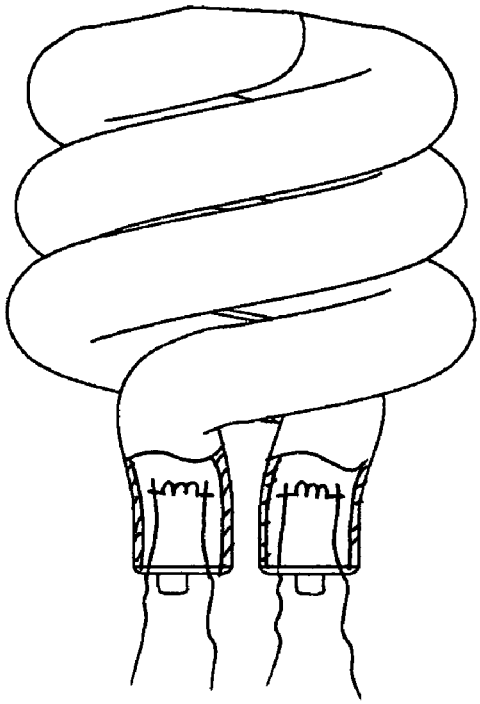
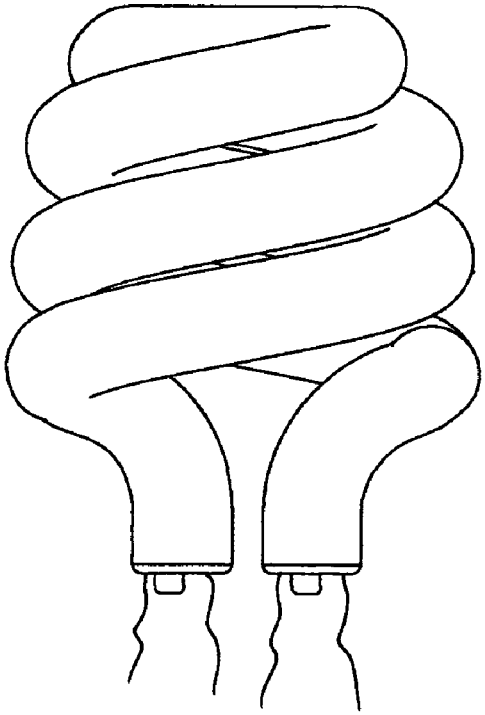
Fig.11 (b)

Fig.14(a)
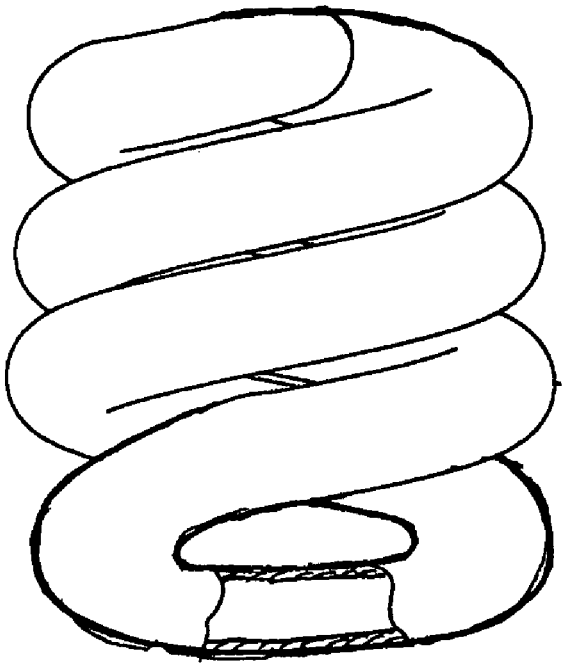
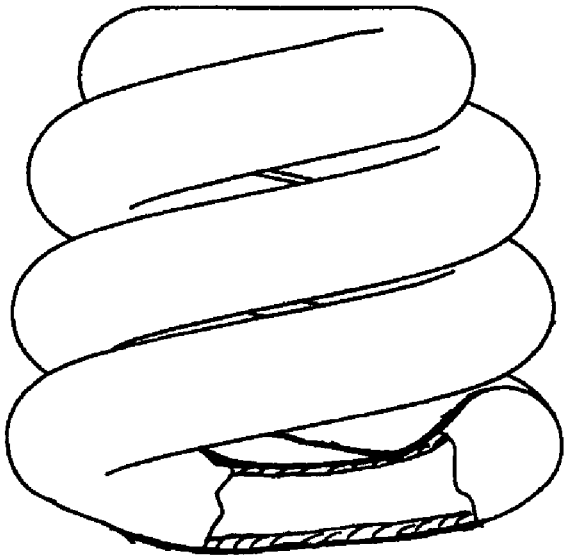
Fig.14(b)

Candelabra S.C. Bayonet
B15

Medium Prefocus
P28s

Mogul Prefocus
P40s

Candelabra Screw
E14

Miniature Bipin
G5.3

GY9.5

GY16

PG12

E27

Medium Screw
E26

E40

Mogul Screw
E39

G23

G24q-1

G24d-1

2G11

ENERGY EFFICIENT COMPACT FLUORESCENT REFLECTOR LAMP

FIELD OF THE INVENTION

The present invention relates to energy efficient reflector lamp fitted with a fluorescent light source, a lens and a pressed glass reflector assembly for directing light produced by the light source, and electronic ballasts system enclosed in a housing attached to the reflector and equipped with a base for connection to the ordinary power line and capable to provide light at particularly high degree of luminous efficacy and adapted as energy efficient replacements for conventional tungsten-halogen incandescent lamps.

BACKGROUND OF THE INVENTION

The Edison type incandescent lamps and tungsten-halogen incandescent lamps are still the primary light sources in residential and commercial lighting fixtures. These lamps generally include incandescent filaments within a predetermined and non-oxidizing atmosphere which contained in a glass envelope. The energized filaments are the sources of light. Despite their wide spread use, all incandescent lamps, including the halogen types, producing approximately 10 to 16 Lumens of light output per each Watt of consumed power and have relatively short, unpredictable service life. Only 15% of electrical energy consumed by the incandescent lamps is converted to the visible light. The rest 85% of the energy is dispersed as heat energy. The average service life of incandescent lamps is varying from 750 Hours to 3,000 hours depending on quality of the manufacturer.

The incandescent lamps are manufactured in may shapes and sizes. The most popular is the teardrop shape mounted in Edison-type base. Other shapes include "R" (Reflector) types or "PAR" (Parabolic Aluminized Reflector) types. The shapes and sizes of all these lamps are dictated by the large amount of heat energy being produced. Further, the sizes and shapes of these lamps lead to specific designs of light fixtures—to fit such lamps and meet appropriate safety standards and municipal fire codes. Also, the shapes and sizes of these incandescent lamps providing desirable optimum distribution of luminous flux.

Additionally, incandescent lamps exhibit warm color of light (approximately 2900 K) and high Color Rendering Index (CRI) (approximately 100).

Fluorescent lamps exhibiting efficiencies as high as 100 lumens per watt (Lm/W) provide attractive alternative to incandescent lighting. Service life of the fluorescent light sources is significantly longer than incandescent and reaches as much as 30,000 hours. Furthermore, approximately 85% of electrical energy consumed by the fluorescent lamps is converted to visible light. The fluorescent lamps are considered to be a cool operation lamps, with a typical bulb wall temperature of 40° C.

The conventional fluorescent lamps, however, require a long tubular envelope and together with a need for auxiliary ballasting equipment, has somewhat limited their acceptance in the market. Increased use of fluorescent illumination, with attendant savings of energy, can be achieved from the development of fluorescent lamps which are directly compatible with incandescent lamps in their shapes, sizes and distribution of light. However, when a conventional fluorescent lamp is reduced in length, the luminous efficacy is greatly reduced. The loss of efficiency in prior art, short arc fluorescent lamps, has been primary attributed to two effects: (1) the voltage drop at the lamp electrodes, and therefore power loss in the lamp remains constant as the arc length is reduced, leaving only a small portion of the lamp input power available for light production; and (2) as the arc length is reduced, the voltage drop across the discharge column is, likewise, reduced. The lamp current, therefore, must be increased to maintain the input power. The positive column efficacy decreases as a function of increasing arc current. Increased lamp current causes lower positive column efficacy and shorter lamp life primarily because of excessive phosphor excitation.

It is, therefore, highly desirable to have highly efficient fluorescent lamps electrically, mechanically, and optically compatible with incandescent or tungsten-halogen incandescent lamps. Such lamps should have relatively low arc current, relatively long arc column, and very high luminous efficacy.

The tungsten-halogen PAR reflector lamps are well known on the market. They are equipped with pressed glass reflectors and lenses. They come in many sizes and have many established application on the market like: store display lighting, down lights in hotels, motels, restaurants, theaters, residences, outdoor lighting, and indoor track lighting, and more. There are number of disadvantages of halogen PAR reflector lamps. For example, a commercially sold 90 W PAR halogen lamp has an average service life of 2500 hours, has luminous efficacy of 16 Lm/W, and emitting light in color temperature limited by tungsten melting temperature to 3000° K. It is highly desirable to have a PAR reflector lamps made with fluorescent light sources having significantly longer service life, having luminous efficacy substantially higher, and having ability to emit light in wide range of color temperatures, like: 3500° K, 4100° K, 5000° K, 6500° K.

This applicant is not aware of any prior art energy efficient PAR reflector lamp fitted with a fluorescent light source, a lens and a pressed glass reflector for directing light produced by the light source, and electronic ballasts system enclosed in a housing attached to the reflector and such PAR lamp is equipped with a base for connection to the ordinary power line and capable to provide light at particularly high degree of luminous efficacy and adapted as energy efficient direct replacements for conventional tungsten-halogen and incandescent PAR reflector lamps.

SUMMARY OF THE INVENTION

Accordingly, it is an object of the present invention to provide a reflector lamp with improved energy efficiency and luminous efficacy.

It is another object of the present invention to provide a reflector lamp with improved service life.

It is yet another object of the present invention to provide a reflector lamp with wide range of color temperatures of emitted light.

It is a further object of the present invention to provide a lamp which can be directly compatible with incandescent and halogen PAR lamps and such lamps can be used in the same type light fixtures as incandescent and halogen PAR lamps.

According to the invention, the above objects are accomplished and a lamp being characterized by:

a fluorescent light source;

a reflector with a defined cavity having circumferential rim defining a light emitting opening, an said cavity having a first circumferential flange defining a mating opening having an inner diameter, and said cavity interior wall defining a reflective surface of the reflector having substantially larger diameter at the circumferential rim than at the circumferential flange.

a lens attached to said circumferential rim of said reflector;

a light source base attached to said fluorescent light source; said base being inside said defined cavity of said reflector and located inside said mating opening; and said base having a second circumferential flange having an outer diameter, and said base having a first locking means;

an electricity supply base;

a ballast for energizing said fluorescent light source to emit light, said ballast including power input terminals connected to said electricity supply base and output terminals connected to said fluorescent light source;

a ballast housing with a defined space to accommodate the electronic ballast; said ballast housing having a second locking means; and said housing having means for attachment of said electricity supply base;

said fluorescent reflector lamp being assembled by mating of said first locking means of the light source base with said second locking means of the ballast housing;

wherein said outer diameter of the second circumferential flange of the light source base is larger than said inner diameter of the first circumferential flange of the reflector cavity;

wherein light emitted by said fluorescent light source being substantially reflected by the reflecting surface of the reflector and directed out of the reflector cavity through said light emitting opening.

The above-described embodiment provides a fluorescent reflector lamp which exhibits substantial energy-savings substitute for commonly known PAR lamps equipped with incandescent filaments, including halogen type, as well as known "R" lamps. The lamp according to this invention fits in the same lampholders and operates off of the same electric power line voltage. The process of retrofit is very simple. Additionally, the fluorescent light source can be designed to operate with any desirable color temperature, unlike the halogen lamps are. There is much greater flexibility for interior designers to choose the light color temperature for a particular environment. Finally, the fluorescent reflector lamp of present embodiment has an outline substantially within that of the ANSI outline for PAR38 lamps, the most commercially popular reflector lamp type.

Reflector Lamp Efficacy Measurements:

The above described fluorescent reflector lamp PAR38 embodiment has a total input power of 23 Watts. Table 1 shows comparison of photometric measurements of this lamp (CFL-PAR38) with a commercially sold 90 Watt halogen PAR38 and a 60 Watt PAR38 with halogen Infra Red burner.

TABLE 1

| LAMP | POWER (Watts) | LUMENS | EFFICACY (Lm/W) | CCT | CRI |
|---|---|---|---|---|---|
| CFL-PAR38 | 23 | 1150 | 50 | 2875 | 84.5 |
| 90 W PAR38 | 90 | 1275 | 14.2 | 2900 | 100 |
| 60 W PAR38 | 60 | 1100 | 18 | 2800 | 95 |

Accordingly, it is clear that the fluorescent reflector lamp is superior to commercially available halogen and halogen PAR lamps. Additionally, by changing the phosphor mix of the fluorescent light source, color temperature of emitted light can be chosen as desired.

BRIEF DESCRIPTION OF THE DRAWINGS

FIG. 11(*a*) and FIG. 11(*b*) show fluorescent light source shaped as helix with filaments;

FIG. 14(*a*) and FIG. 14(*b*) show electrodeless fluorescent light source formed in as shape of helix;

DESCRIPTION OF THE PREFERRED EMBODIMENTS

Figure 1:
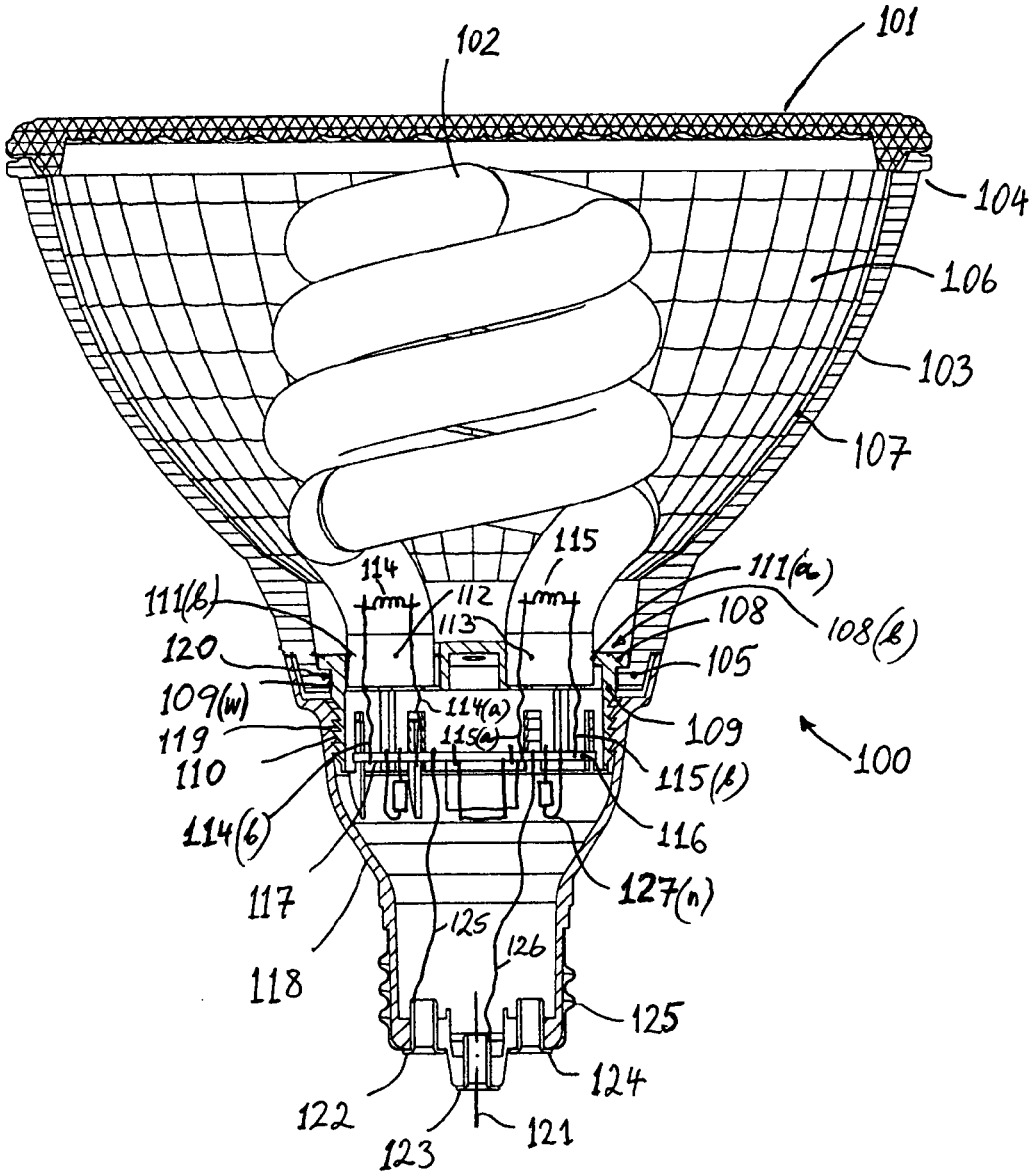
FIG. 1 shows a fluorescent reflector lamp having unitary structure including a reflector enclosed by a lens, a ballast and a housing enclosing the ballast and holding the reflector unit.

FIG. 1 shows a fluorescent reflector lamp 100 having a reflector 103 and a cover in the form of pressed glass lens 101 is attached to the reflector at a rim 104 with use of adhesive material like silicone or epoxy. The reflector has a parabolic surface 106 extending from the rim to a flange 105. The parabolic surface has a reflective coating 107 thereon, such as aluminum. Other suitable materials for reflective coating ma be used as silver and multi-layer dichroic coatings. The flange 105 has a mating opening 120 of a particular inner diameter. A light source base 108(*b*) has a tubular section 109 and has a flange 108 with an outer diameter larger than said inner diameter. The tubular section is made with a diameter appropriate for easy insertion into the opening of the flange 105. Said tubular section has outer wall 109(*w*) made with multiple outer hooks 110. A fluorescent light source 102 made of glass tube is formed in a shape of helix and has two ends as straight sections 112 and 113 where filaments 114 and 115 are located. The light source base 108 is made with two round holes 111*a* and 11*b* where the two straight ends 112 and 113 of the light source are inserted during assembly—one to each hole, accordingly. The assembly of the light source into the light source base is secured with appropriate adhesive like silicone, epoxy, or other type applicable for relatively high temperature applications. The filaments 114 and 115 have their lead wires 114(*a*), 114(*b*), 115(*a*), and 115(*b*) respectively, coming out of the straight end sections 112, 113, respectively.

The lead wires are connected with a ballast 116 made with various electronic components 127(*n*) assembled on a printed circuit board 117. A housing 118 molded from a synthetic resin material which withstands the operating temperatures of the lamp. The most suitable materials include PBT and polycarbonate. The housing has internally molded inner hooks 119 which are matching with the outer hooks 110 of the light source base. The hooks are designed and made to lock to each other during the assembly process and create positive lock between the light source base and the housing. The housing is designed and molded in such a way that its shape is compatible with a shape of the reflector cavity at the flange 105 and the mating opening 120. Furthermore, the housing is designed and molded in a shape and size to accommodate requirements as designated in ANSI (American National Standard Institute) for PAR lamps. The housing diameter should be approximately 40 millimeters in diameter. The ballast can be assembled on the printed circuit board circular in shape located in perpendicular relation to an axis 121 of the lamp, or (FIG. 7) in odd shape located in parallel relation to the axis 721. Additionally, the housing is designed and molded to accommodate an electricity supply base 125 riveted to the housing with use of rivet 122 and rivet 124. The shell of the electricity supply base is used as a fist electrical contact. A third rivet 123 is located in the center of the lamp and is used as a second electrical contact. The ballast has two supply wires 125, 126 electrically connected to the first and the second electrical contacts, respectively.

Figure 2:
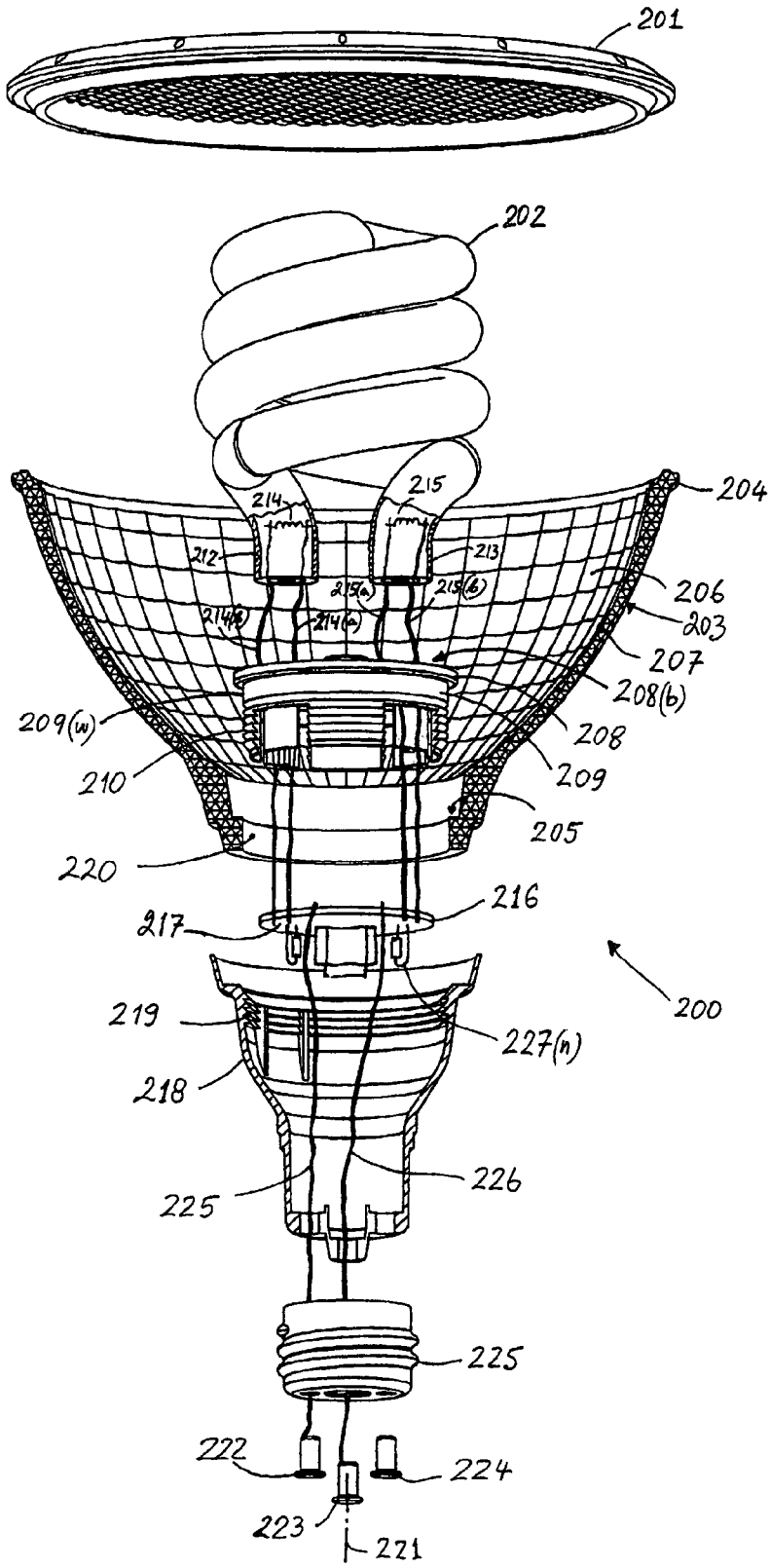
FIG. 2 shows component parts of the fluorescent reflector lamp in exploded view.

FIG. 2 shows the reflector lamp 200 as an exploded assembly with all its components moved along an axis 221 for more detail description of each component and more descriptive relationships between respective components.

FIG. 2 shows a fluorescent reflector lamp 200 having a reflector 203 and a cover in the form of pressed glass lens 201 is attached to the reflector at a rim 204 with use of adhesive material like silicone or epoxy. The reflector has a parabolic surface 206 extending from the rim to a flange 205. The parabolic surface has a reflective coating 207 thereon, such as aluminum. Other suitable materials for reflective coating ma be used as silver and multi-layer dichroic coatings. The flange 205 has a mating opening 220 of a particular inner diameter. A light source base 208(*b*) has a tubular section 209 and has a flange 208 with an outer diameter larger than said inner diameter. The tubular section is made with a diameter appropriate for easy insertion into the opening of the flange 205. Said tubular section has outer wall 209(*w*) made with multiple outer hooks 210. A fluorescent light source 202 made of glass tube is formed in a shape of helix and has two ends as straight sections 212 and 213 where filaments 214 and 215 are located. The light source base 208 is made with two round holes 211*a* and 211*b* where the two straight ends 212 and 213 of the light source are inserted during assembly—one to each hole, accordingly. The assembly of the light source into the light source base is secured with appropriate adhesive like silicone, epoxy, or other type applicable for relatively high temperature applications. The filaments 214 and 215 have their lead wires 214(*a*), 214(*b*), 215(*a*), and 215(*b*) respectively, coming out of the straight end sections 212, 213, respectively. The lead wires are connected with a ballast 216 made with various electronic components 227(*n*) assembled on a printed circuit board 217. A housing 218 molded from a synthetic resin material which withstands the operating temperatures of the lamp. The most suitable materials include PBT and polycarbonate. The housing has internally molded inner hooks 219 which are matching with the outer hooks 210 of the light source base. The hooks are designed and made to lock to each other during the assembly process and create positive lock between the light source base and the housing. The housing is designed and molded in such a way that its shape is compatible with a shape of the reflector cavity at the flange 205 and the mating opening 220. Furthermore, the housing is designed and molded in a shape and size to accommodate requirements as designated in ANSI (American National Standard Institute) for PAR lamps. The housing diameter should be approximately 40 millimeters in diameter. The ballast can be assembled on the printed circuit board circular in shape located in perpendicular relation to an axis 221 of the lamp, or (FIG.) in odd shape located in parallel relation to the axis 221. Additionally, the housing is designed and molded to accommodate an electricity supply base 225 riveted to the housing with use of rivet 222 and rivet 224. The shell of the electricity supply base is used as a first electrical contact. A third rivet 223 is located in the center of the lamp and is used as a second electrical contact. The ballast has two supply wires 225, 226 electrically connected to the first and the second electrical contacts, respectively.

Figure 3:
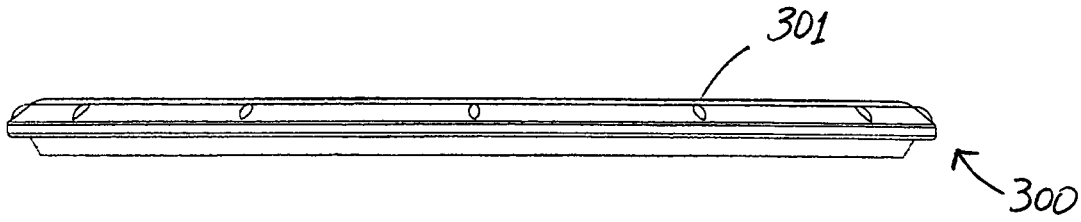
FIG. 3 and FIG. 4 show lenses as can be implemented in this invention.

FIG. 3 shows a lens 300 of the preferred embodiment of the reflector lamp, said lens having flat outside surface 301.

Figure 4:
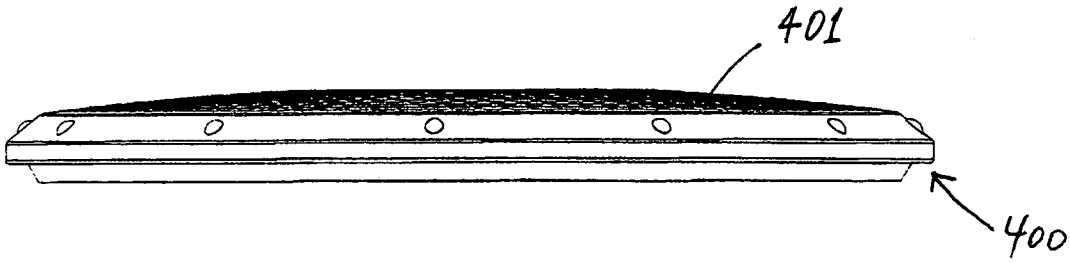

FIG. 4 Shows a lens 400 of another embodiment of the reflector lamp, said lens having convex outside surface 401.

Figure 5:
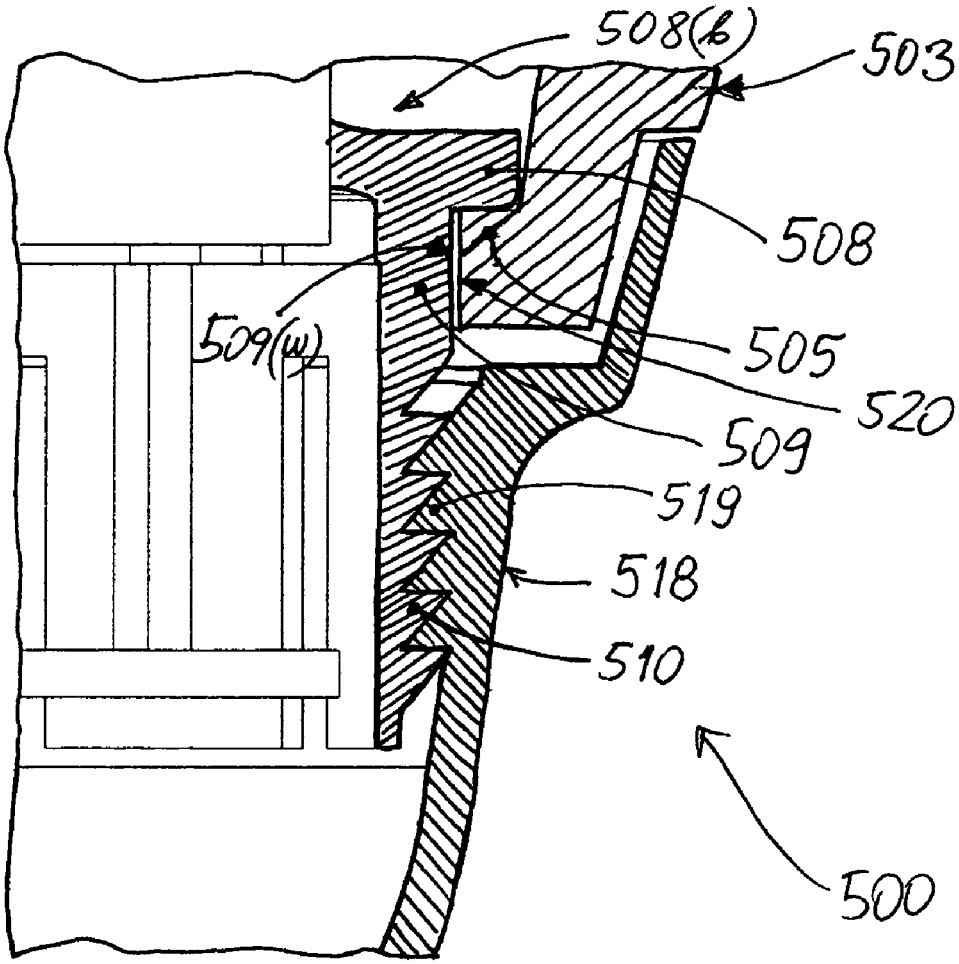
FIG. 5 shows a detail view of assembly relationship of the light source base, the reflector, and the housing.

FIG. 4 shows an enlarged detail 500 of the preferred embodiment of the reflector lamp of FIG. 5. shows a detail view 500 of assembly relationship of the following component parts: (i) the light source base 508(*b*) and the reflector 503; the flange 508 and the flange 505; the outer wall 509(*w*) and the mating opening 520; the inner hooks 519 and the outer hooks 510; the reflector 503 and the ballast housing 518.

Figure 6:
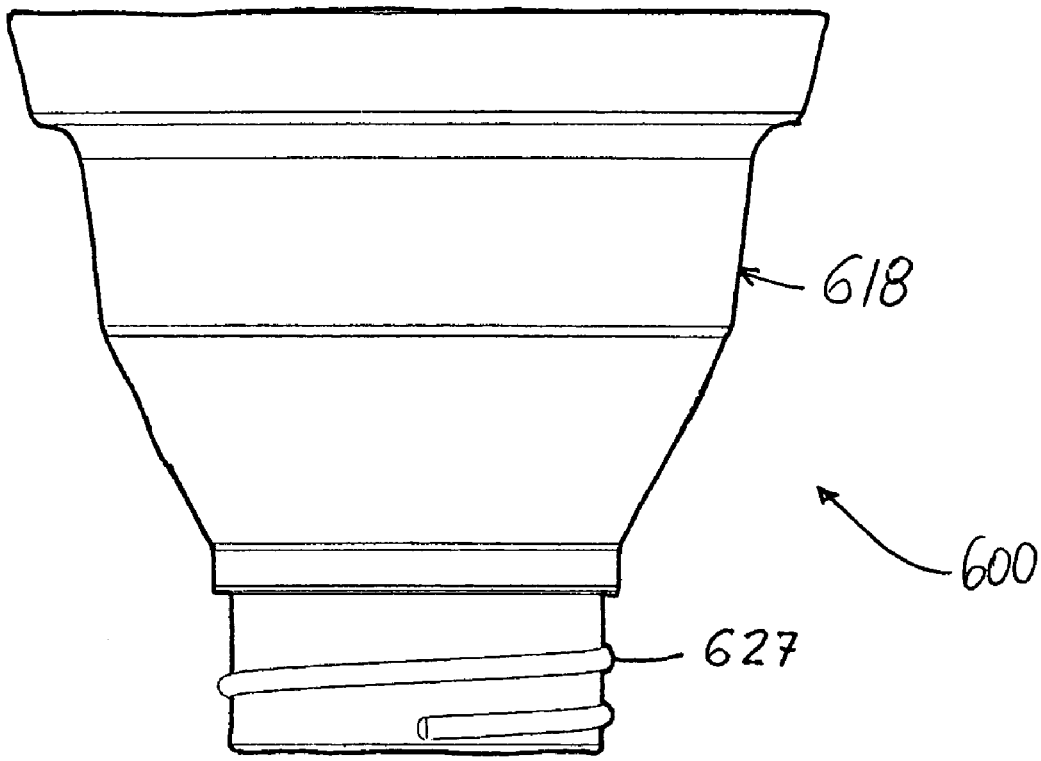
FIG. 6 shows a ballast housing with a base thread designed to accept assembly of commonly known Edison type screw base.

FIG. 6 shows a ballast housing 600 of another embodiment of the reflector lamp; said housing has a base thread which is designed to accept assembly of commonly known Edison type screw base.

Figure 7:
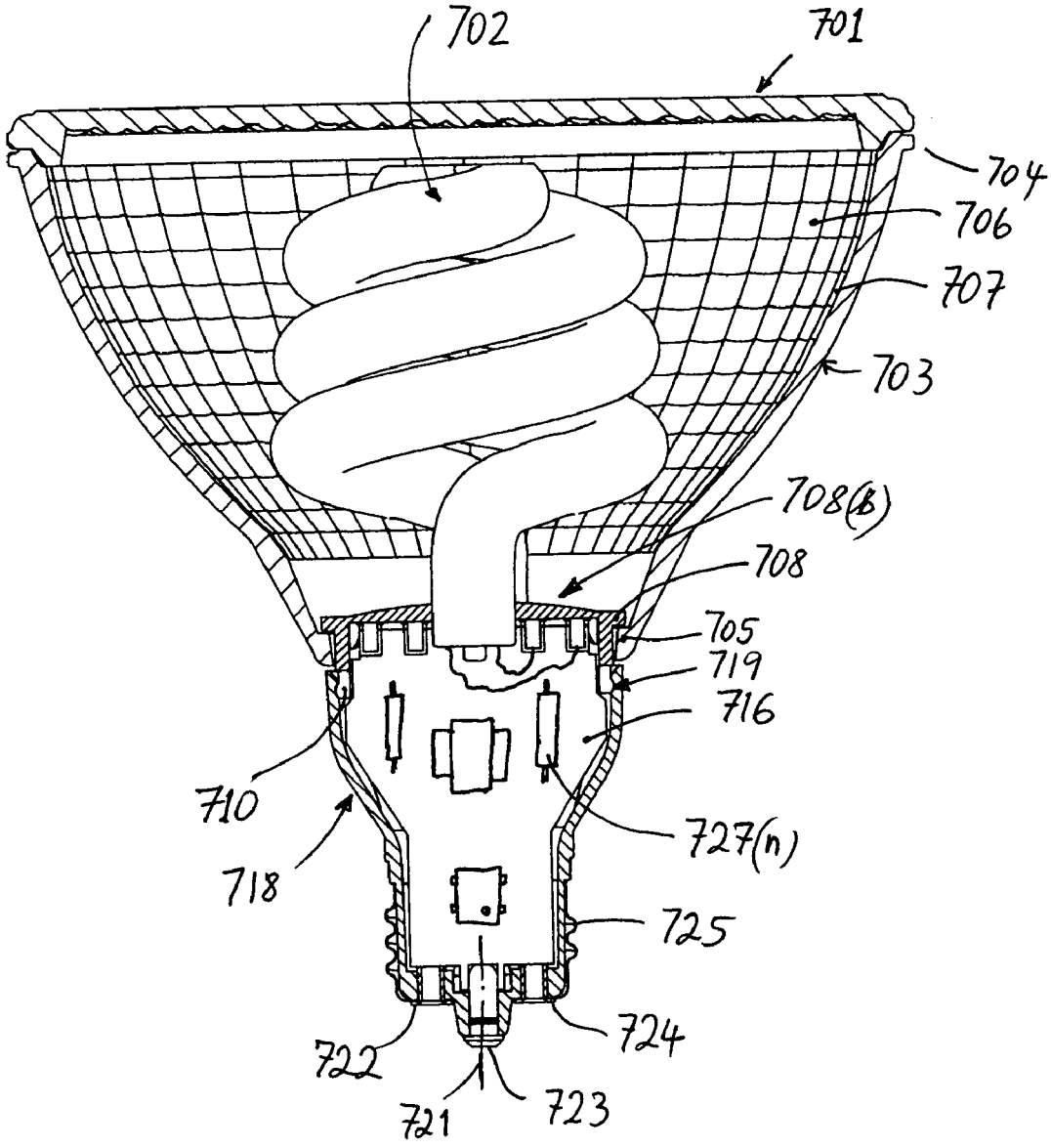
FIG. 7 shows use of single point lock system made of a bump and a groove and a ballast positioned in parallel relation to lamp axis.

FIG. 7 shows yet another embodiment of the present invention wherein a light source base 708(*b*) is locked together to a housing 718 with use of single point lock system made of a bump 710 and a groove 719. Additionally, it is another embodiment of the present invention where a ballast 716 is positioned in parallel relation to an axis 721.

Figure 8:
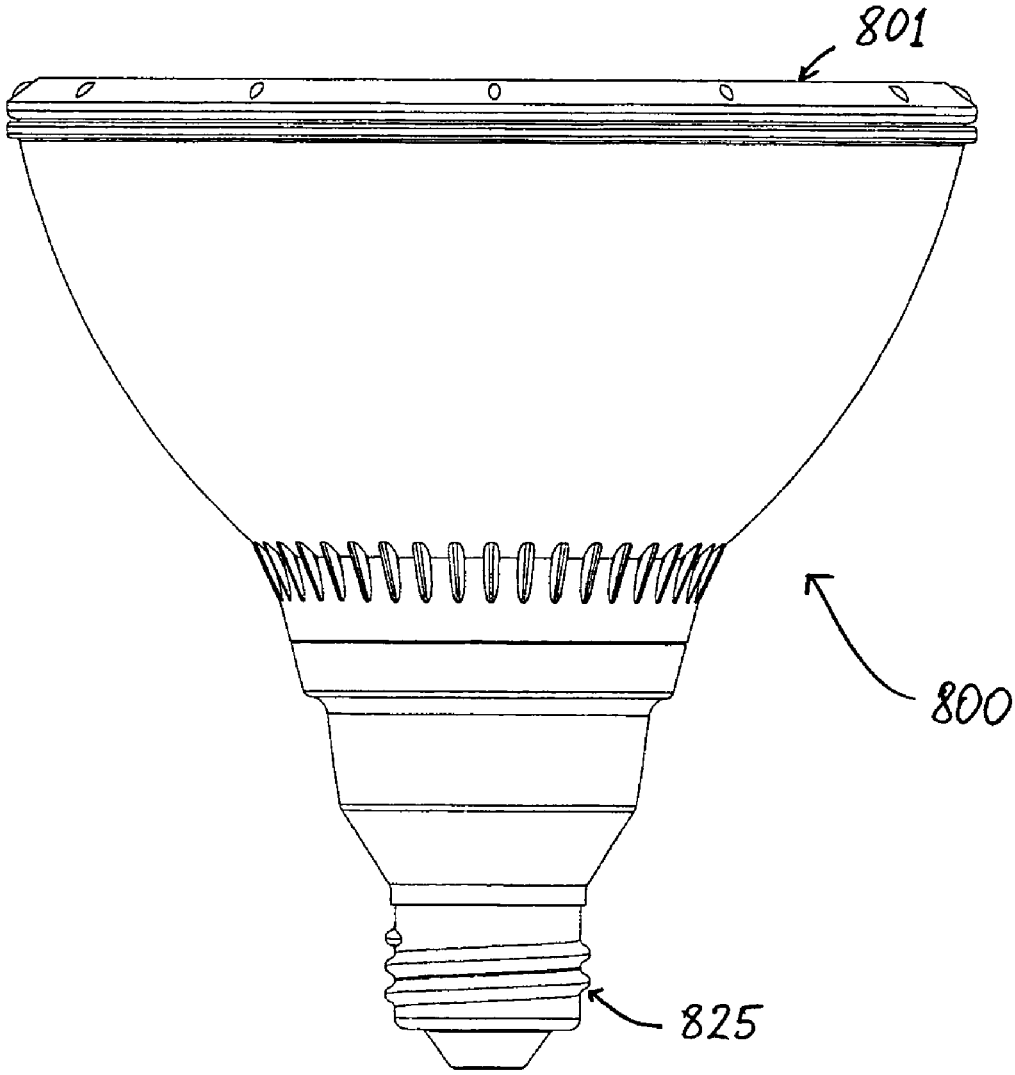
FIG. 8 shows the reflector lamp with threaded base and flat lens, and said lamp being substantially within the ANSI specified outline for PAR38 lamp.

FIG. 8 shows another embodiment of the reflector lamp of FIG. 1 wherein the lamp is made with threaded base. 825 and flat lens 801, and said lamp has outline fitting substantially within the ANSI specified outline for PAR38 lamp with lens diameter being approximately equal to 120 millimeters.

Figure 9:
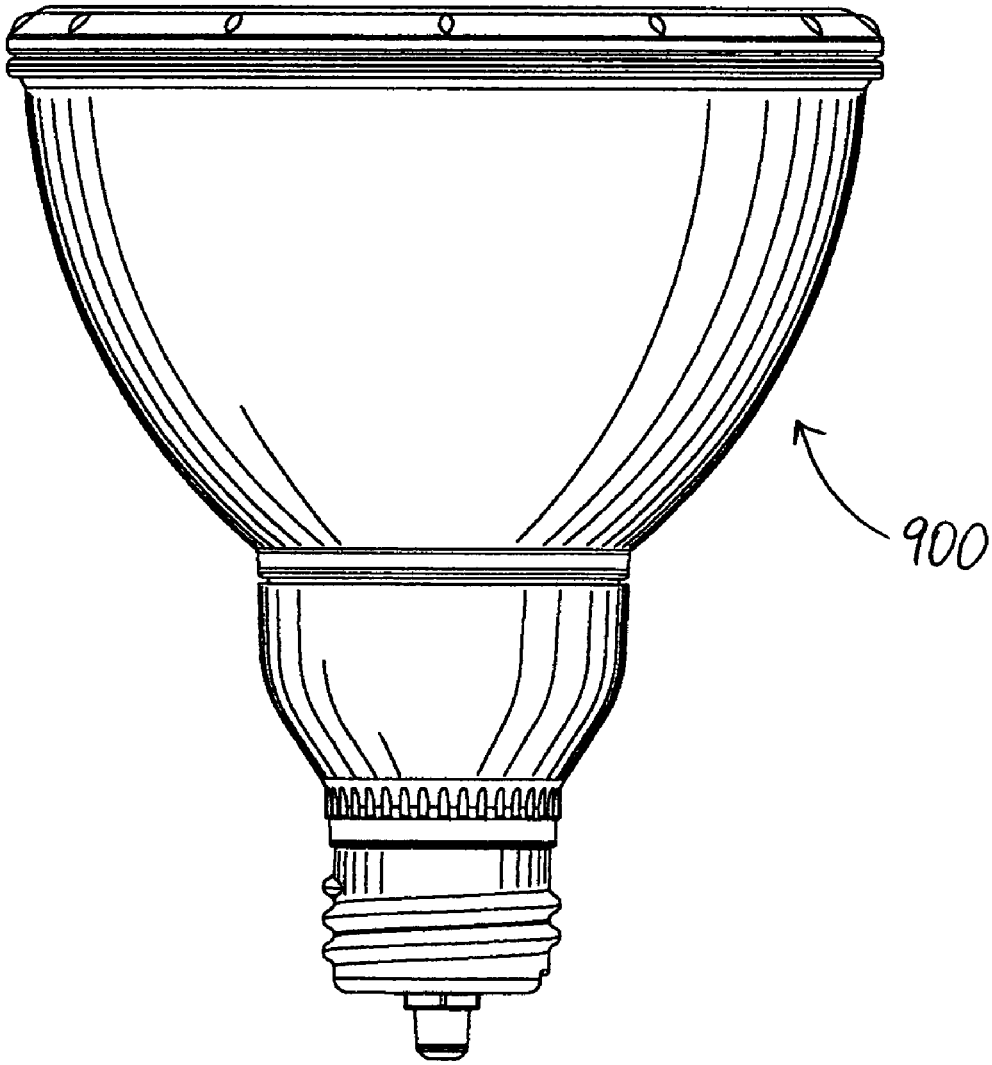
FIG. 9 shows PAR30 fluorescent reflector lamp.

FIG. 9 shows another embodiment of the reflector lamp of FIG. 1 wherein the lamp has outline fitting substantially within the ANSI specified outline for PAR30 lamp with lens diameter being approximately equal to 95 millimeters.

Figure 10:
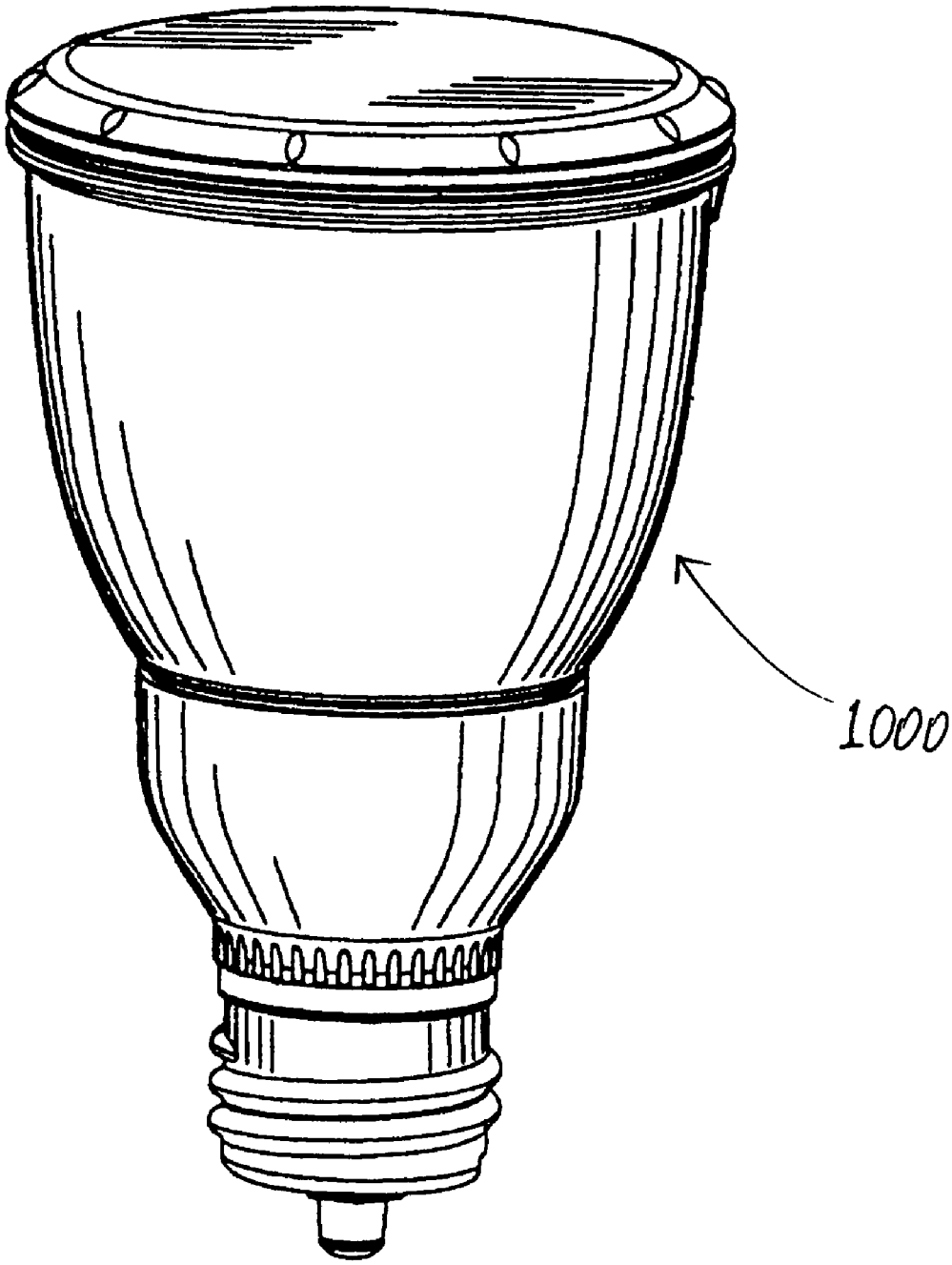
FIG. 10 shows PAR20 fluorescent reflector lamp.

FIG. 10 shows another embodiment of the reflector lamp of FIG. 1 wherein the lamp has outline fitting substantially within the ANSI specified outline for PAR20 lamp with lens diameter being approximately equal to 64 millimeters.

FIG. 11(*a*) and FIG. 11(*b*) show two views of the light source of the preferred embodiment of the present invention; the light source is made of glass tube formed in shape of a helix; and said light source has two straight sections defined as the ends of the tube.

Figure 12:
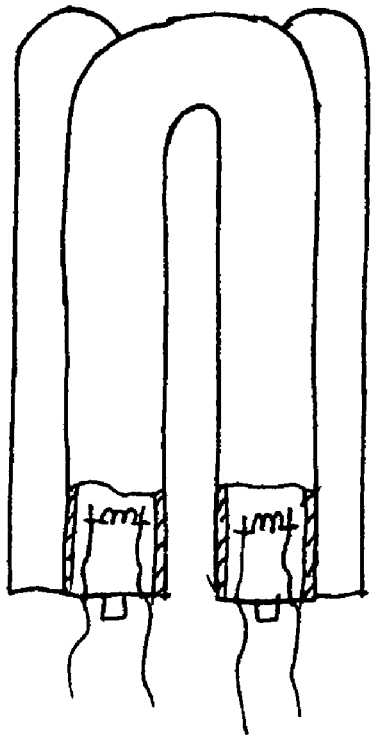
FIG. 12(*a*) and FIG. 12(*b*) show fluorescent light source as quad lamp with filaments.
Figure 12:
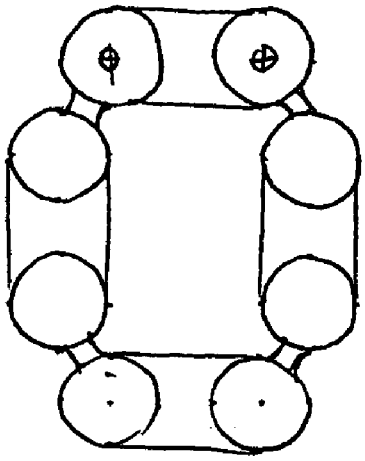

FIG. 12(*a*) and FIG. 12(*b*) show two views of a light source on another embodiment of the present invention; the light source is made as commonly known fluorescent light source made with multiple sections of glass tube sections forming single light source having defined ends equipped with filaments wires for assembly into the light source base and connection to the ballast.

Figure 13:
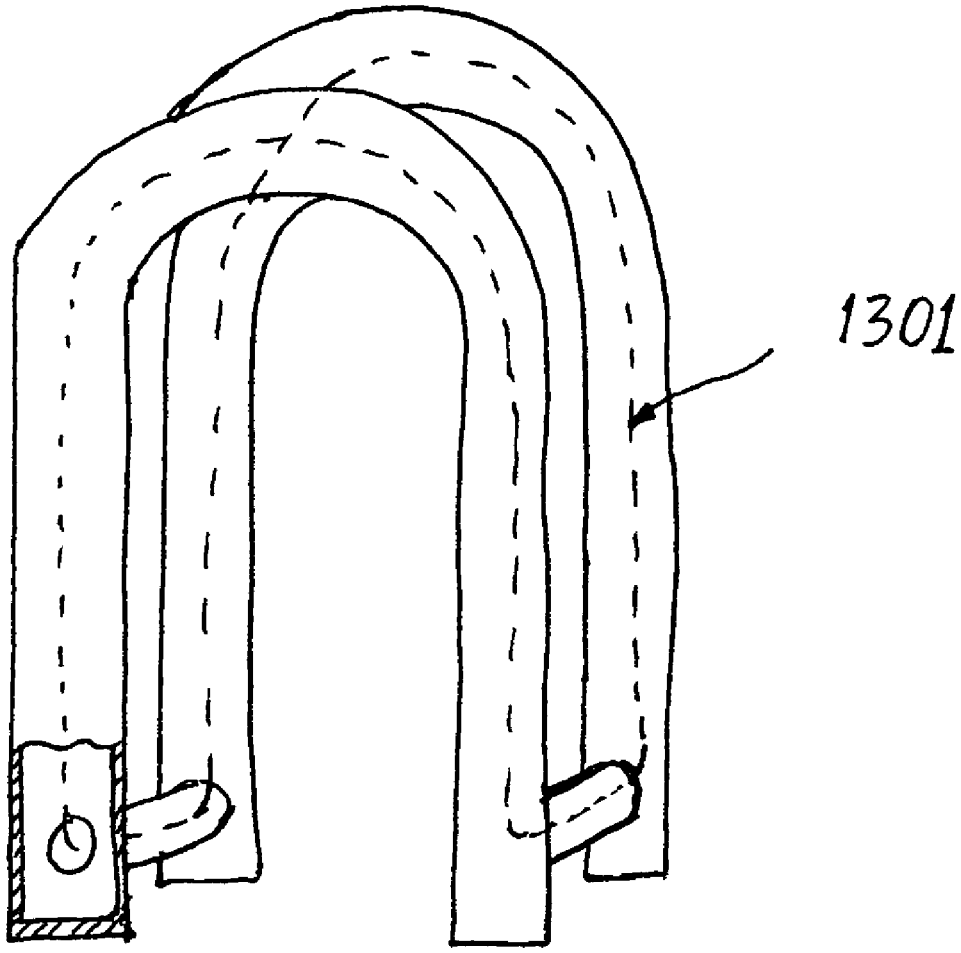
FIG. 13 shows electrodeless fluorescent light source made as double U-type.
Figure 15A:
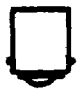
FIG. 15(*a*)–(*p*) show examples of electricity supply bases.
Figure 15B:
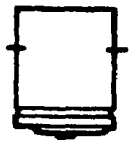
Figure 15C:
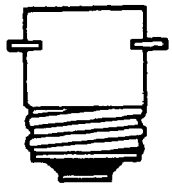
Figure 15D:
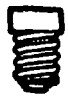
Figure 15E:
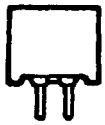
Figure 15F:
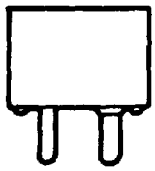
Figure 15G:
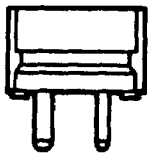
Figure 15H:
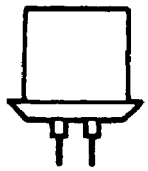
Figure 15I:
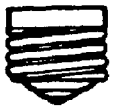
Figure 15J:
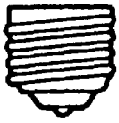
Figure 15K:
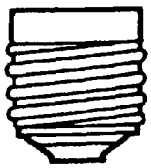
Figure 15L:
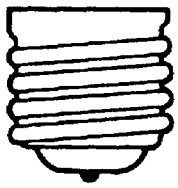
Figure 15M:
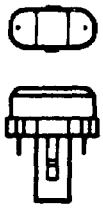
Figure 15N:
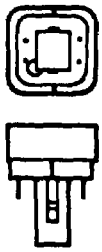
Figure 15O:
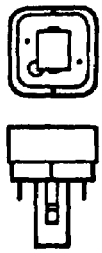
Figure 15P:
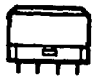
Figure 16:
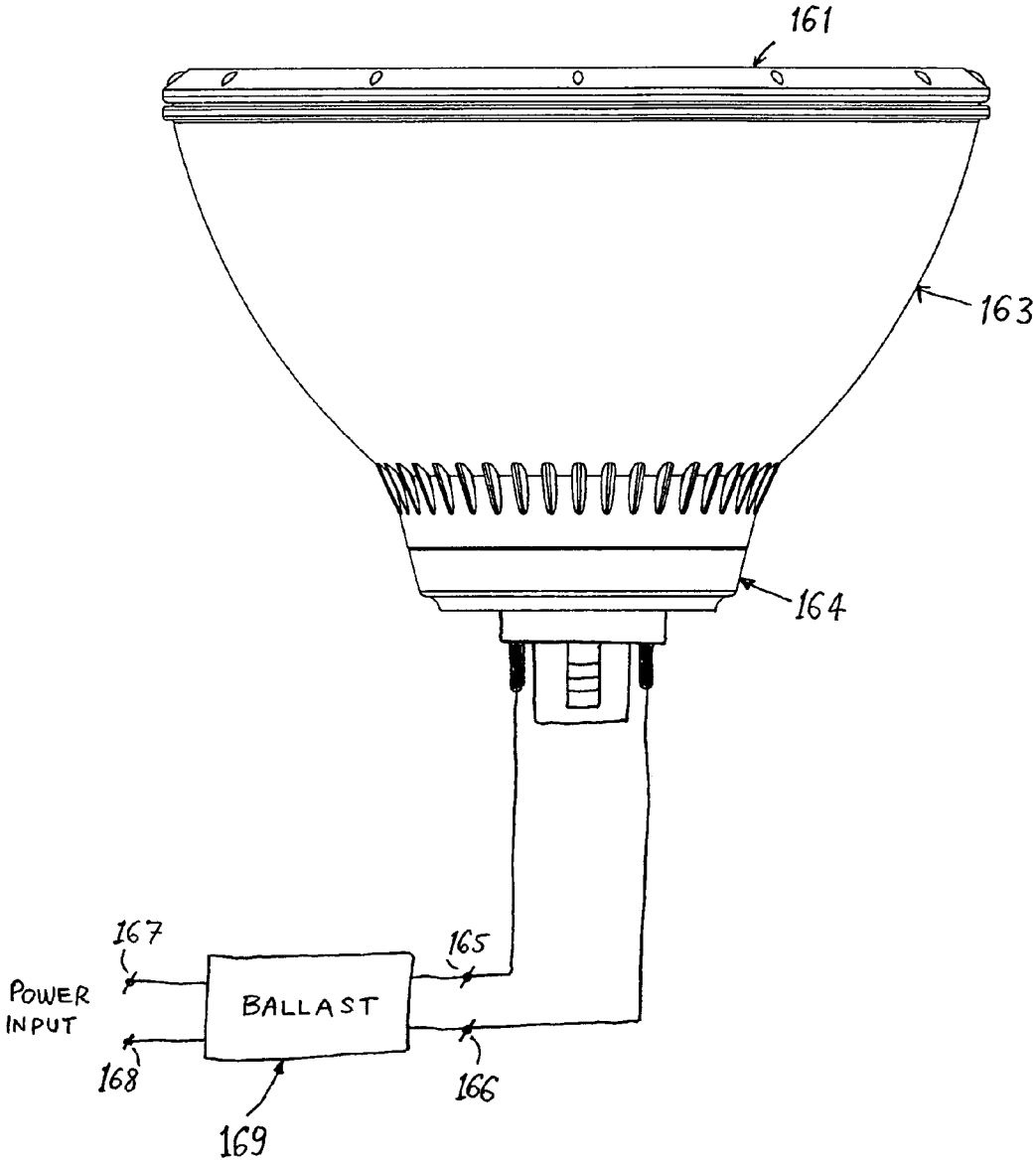
FIG. 16. shows fluorescent reflector lamp with remote ballast.
Figure 17:
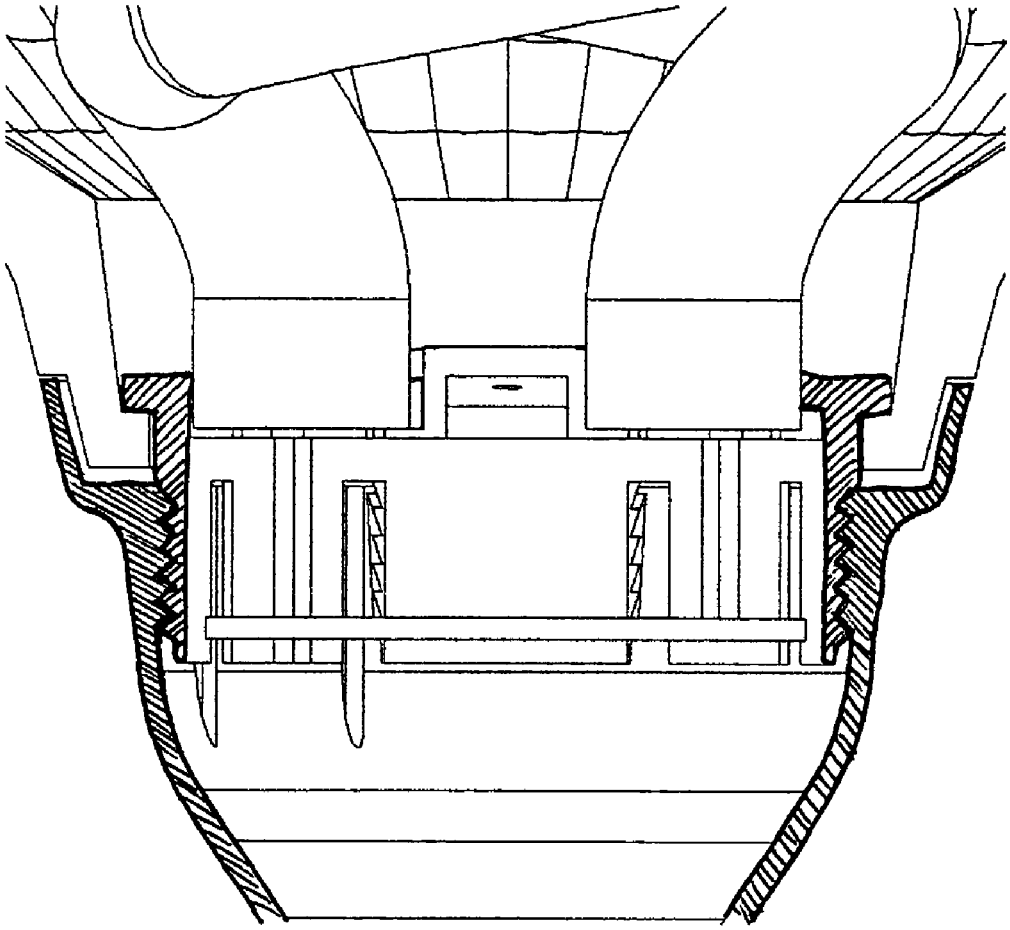
FIG. 17 shows thread locking between light source base and the housing.

FIG. 13 shows a light source as yet another embodiment of the present invention; said light source is made in electrodeless version and is made of multiple glass tube sections, and said light source is made as a closed loop without defined ends.

FIG. 14(*a*) and FIG. 14(*b*) show two views of a light source as another embodiment of the present invention; said light source is made as electrodeless version and is made of glass tube formed in a shape of a helix, and said light source is made as closed loop without defined ends.

Other Comments

A fluorescent reflector lamp of present invention including all possible embodiments are designed to have all light sources energized by an electronic type ballasts where the light source arc current has frequency above 25 kHz. Such ballasts are commonly designed to draw their energy from an ordinary AC power line. However, the electronic ballasts can be modified to operate from any DC power source.

It is understood that having a ballast as a remote device to energize a compact fluorescent reflector lamp equipped with any custom or industry standard electricity supply base shall fall into a scope of this invention. Examples of such bases are provided in FIG. 15(*a*)–FIG. 15(*p*).

It is understood that fluorescent light source may be made with disconnectable electrical contacts to allow replacement of the light source, for example, if the ballast is designed to have longer life than the light source.

I claim:

1. A fluorescent reflector lamp comprised of:

a fluorescent light source;

a reflector with a defined cavity having circumferential rim defining a light emitting opening, and said cavity having a first circumferential flange defining a mating opening having an inner diameter, and said cavity having an interior wall defining a reflective surface of the reflector having substantially larger diameter at the circumferential rim than at the circumferential flange a lens attached to said circumferential rim of said reflector;

a light source base attached to said fluorescent light source; said base being inside said defined cavity of said reflector and located inside said mating opening; and said base having a second circumferential flange having an outer diameter, and said base having a first locking means;

an electricity supply base;

a ballast for energizing said fluorescent light source to emit light, said ballast including power input terminals connected to said electricity supply base and output terminals connected to said fluorescent light source;

a ballast housing with a defined space to accommodate the electronic ballast; said ballast housing having a second locking means; and said housing having means for attachment of said electricity supply base;

said fluorescent reflector lamp being assembled by mating of said first locking means of the light source base with said second locking means of the ballast housing;

wherein said outer diameter of the second circumferential flange of the light source base is larger than said inner diameter of the first circumferential flange of the reflector cavity;

wherein light emitted by said fluorescent light source being substantially reflected by the reflecting surface of the reflector and directed out of the reflector cavity through said light emitting opening.

2. The device according to claim 1 wherein the fluorescent light source is made of glass tube formed in a shape of a helix having defined ends equipped with filaments wires for assembly into the light source base and connection to the ballast.

3. The device according to claim 1 wherein the fluorescent light source made of multiple glass tubes sections forming single light source having defined ends equipped with filaments wires for assembly into the light source base and connection to the ballast.

4. The device according to claim 1 wherein the fluorescent light source is made of glass tube formed in a shape of a helix and made as a closed loop without defined ends.

5. The device according to claim 1 wherein the fluorescent light source is made of multiple glass tube sections forming single light source made as closed loop without defined ends.

6. The device according to claim 1 wherein the reflector is made either of (i) pressed glass; (ii) metal, or (iii) synthetic resin material.

7. The device according to claim 6 wherein said lamp has outline fitting substantially within the ANSI specified outline for PAR38 lamp.

8. The device according to claim 6 wherein said lamp has outline fitting substantially within the ANSI specified outline for PAR30 lamp.

9. The device according to claim 6 wherein said lamp has outline fitting substantially within the ANSI specified PAR20 lamp.

10. The device according to claim 1 wherein the lens has flat outer surface and said lens is made of any light transmitting material like glass or synthetic resin.

11. The device according to claim 1 wherein the lens has convex outer surface and said lens is made of any light transmitting material like glass or synthetic resin.

12. The device according to claim 1 wherein the light source base having the first locking means as outer bump and the ballast housing having the second locking means as inner groove, and said mating of the outer bump with the inner groove resulting in as single point lock between the light source base and the ballast housing.

13. The device according to claim 1 wherein the light source base having first locking means as multiple outer hooks and the ballast housing having the second locking means as multiple inner hooks, and said mating of the multiple outer hooks with the multiple inner hooks resulting in multiple point lock between the light source base and the ballast housing.

14. The device according to claim 1 wherein the light source base having the first locking means as an outer thread and the ballast housing having the second locking means as an inner thread, and said mating of outer thread with the inner thread is accomplished by threading the outer thread and the inner thread to each other.

15. The device according to claim 1 wherein said electricity supply base is attached to the ballast housing by means of rivets.

16. The device according to claim 1 wherein said ballast housing having a base thread and the electricity supply base is attached to said ballast housing by means of said base thread.

17. The device according to claim 1 wherein said lamp has luminous efficacy of at least 40 Lm/W.

18. A fluorescent reflector lamp comprised of:

a fluorescent light source;

a reflector with a defined cavity having circumferential rim defining a light emitting opening, and said cavity having a first circumferential flange defining a mating opening having an inner diameter, and said cavity having an interior wall defining a reflective surface of the reflector having substantially larger diameter at the circumferential rim than at the circumferential flange a lens attached to said circumferential rim of said reflector;

a light source base attached to said fluorescent light source; said base being inside said defined cavity of said reflector and located inside said mating opening; and said base having a second circumferential flange having an outer diameter, and said base having a first locking means;

an electricity supply base;

a remote ballast for energizing said fluorescent light source to emit light, said ballast including power input terminals and output terminals connected to said electricity supply base;

a housing with a defined shape to accommodate assembly with the reflector; said housing having a second locking means; and said housing having means for attachment of said electricity supply base;

said fluorescent reflector lamp being assembled by mating of said first locking means of the light source base with said second locking means of the housing;

wherein said outer diameter of the second circumferential flange of the light source base is larger than said inner diameter of the first circumferential flange of the reflector cavity, wherein light emitted by said fluorescent light source being substantially reflected by the reflecting surface of the reflector and directed out of the reflector cavity through said light emitting opening.

* * * * *